United States Patent [19]

Thurman et al.

[11] Patent Number: 4,502,542

[45] Date of Patent: Mar. 5, 1985

[54] WELL SYSTEM

[75] Inventors: Robert L. Thurman, McKinney; Jimmie R. Williamson, Jr., Carrollton, both of Tex.

[73] Assignee: Otis Engineering Corporation, Dallas, Tex.

[21] Appl. No.: 532,589

[22] Filed: Sep. 16, 1983

[51] Int. Cl.[3] ..... E21B 34/10

[52] U.S. Cl. ..... 166/325; 166/332; 166/317

[58] Field of Search ..... 166/325, 317, 322, 318, 166/332–334, 328, 330, 323, 319, 321, 373, 133, 188; 137/68 R

[56] References Cited

U.S. PATENT DOCUMENTS

| | | | |
|---|---|---|---|
| 3,053,322 | 9/1962 | Kline | 166/318 X |
| 3,386,701 | 6/1968 | Potts | 166/330 X |
| 3,865,191 | 2/1975 | Mott | 166/325 X |
| 4,311,197 | 1/1982 | Hushbeck | 166/332 X |
| 4,365,671 | 12/1982 | Long | 166/332 X |
| 4,415,027 | 11/1983 | Russell | 166/330 X |

*Primary Examiner*—James A. Leppink
*Assistant Examiner*—Thuy M. Bui
*Attorney, Agent, or Firm*—Roland O. Cox

[57] ABSTRACT

Disclosed is a well system, particularly adapted to pumpdown operation in which lowering an easily retrievable tool string, including an improved standing valve, into an improved foot valve opens the foot valve for production flow. The standing valve prevents flow into the producing formation when the foot valve is open. Lifting the tool string from the foot valve closes the foot valve to protect the producing formation when the tool string is retrieved. Means are provided retaining the foot valve in open or closed positions. Provisions are made for pumping into the formation around both the standing valve and foot valve when closed.

12 Claims, 9 Drawing Figures

WELL SYSTEM

BACKGROUND

This invention relates to well systems particularly adapted for pumpdown operation, and an improved standing valve for use in a retrievable tool string, which cooperates with an improved foot valve, to protect the producing formation from pressure on or flow into during operation of the well.

It is often imperative during well completion and operation, especially if the well is operated using pumpdown or through-flow-line and pumpdown techniques, to protect the producing formation from overpressuring or pumping appreciable volumes into to prevent damage to or kill the formation.

Formation protection is provided by the Well System of U.S. Pat. No. 4,365,671 to Olen R. Long, herein incorporated for reference, but the tool string has been found difficult, if not impossible to pump out and retrieve because of down forces on the tool string being almost equal to up forces developed as pumpout pressure is applied through the H-member cross flow passage between locomotive pistons and the standing valve seal to retrieve the tool string. The locomotive pistons and standing valve seal have very nearly the same sealed area, and pressure introduced between these seals merely places the tool string in tension, and it is not strongly urged to move up tubing and close the foot valve.

Additionally, when the ball valve member in the foot valve of the aforementioned U.S. patent is closed, higher pressures below produce greater upward forces, on the piston sealed in the lower body and on the seat, sealed in the piston, tending to crush the valve ball member. These upward forces also press the seat on the ball, greatly increasing rubbing friction forces which induce high stresses in the ball rotating mechanism when opening the foot valve. If these upward forces become great enough, the shear pin positioning the piston on the seat may be prematurely sheared and fluids may inadvertently bypass the closed foot valve and flow into the formation below, with severely damaging results.

SUMMARY

The well system of the present invention prevents pressuring of or pumping into the producing formation in a well. An improved foot valve in the producing string controls flow from and into the producing formation. An improved standing valve in a tool string, which operates the foot valve, prevents flow into the formation through the foot valve when the foot valve is opened to produce the well. Both valves may be bypassed if pumping into the formation is ever required. The operating tool string includes an improved extendable standing valve, attached to the lower end of the string, and an Improved Shifting Tool of copending U.S. patent application Ser. No. 422,739 filed Sept. 24, 1982 now U.S. Pat. No. 4,436,152. The tool string may include a locking mandrel.

The extendable standing valve has a lower housing with a seal and an extendable upper body with a seal. Both seals seal in the foot valve upper seat extension when the tool string is installed in and opens a cooperating foot valve in the invention system. When pumpout pressure is applied to the system to pump the tool string out and close the foot valve, pressure is transmitted to between the standing valve body seals. As the lower body is landed on a shoulder in the foot valve extension and is not moved downwardly by pressure, the upper body seal is moved upwardly, extending the standing valve body, moving the shifting tool upwardly and closing the foot valve.

The improved foot valve utilizes a spring to maintain a force upward on the lower seat for constant sealing engagement with the ball valve member. Unlike previous foot valves, higher pressures below the closed invention foot valve produce greatly reduced upward forces pressing the lower seat to the ball valve. Any upward forces on the piston are transmitted into a shoulder in the body and do not move the piston and seat upwardly or load the piston positioning pin in shear.

An object of this invention is to provide an improved well system preventing flow into the producing formation in a well.

Another object of this invention is to provide an improved well foot valve which is easily opened when higher pressure is below.

Another object of this invention is to provide a well foot valve which cannot be opened by higher pressure below.

Another object of this invention is to provide a tool string, cooperable with the improved foot valve, and including an improved standing valve, which will open the foot valve for production flow when installed and close the foot valve to protect the producing formation when removed.

Another object of the invention is to provide an improved standing valve, which cooperates with the improved foot valve to provide positive up forces to move the tool string up and out of the foot valve as pumpout pressure is applied in the well system.

Also an object of this invention is to provide a foot valve having means retaining the valve open or closed.

DRAWINGS DESCRIPTION

PREFERRED EMBODIMENT DESCRIPTION

Figure 1:
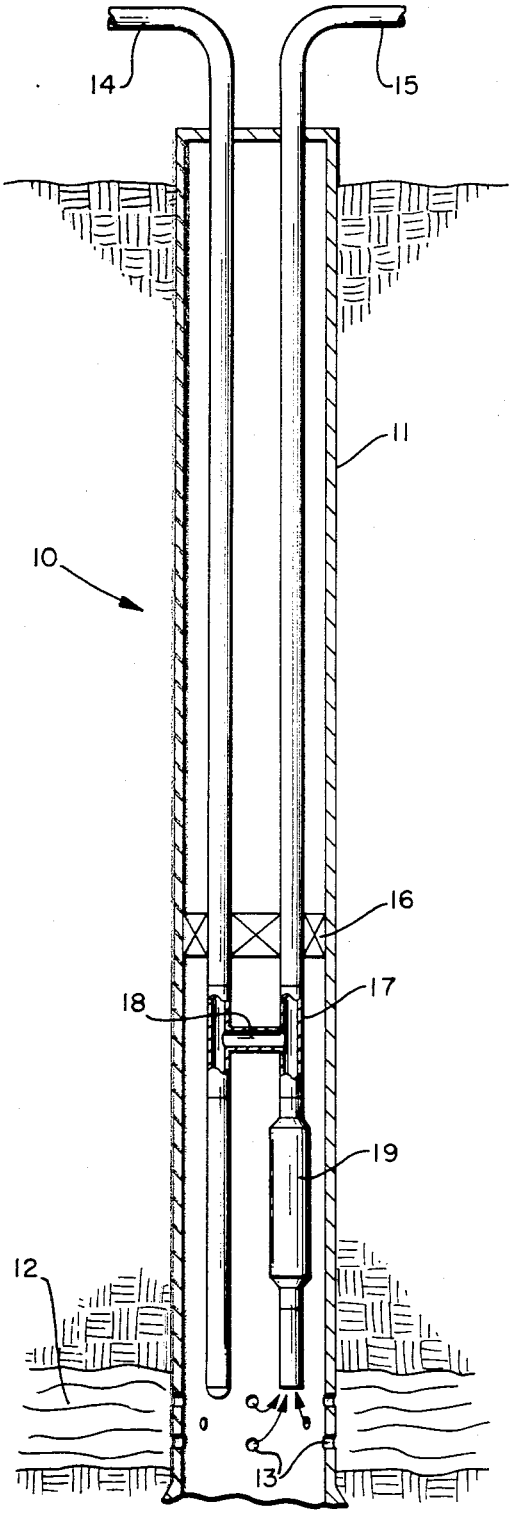
FIG. 1 is a schematic drawing of the well system of this invention, having an improved foot valve of this invention therein.

The invention well system 10 shown in FIG. 1 includes casing 11 passing through a producing formation 12. The casing has perforations 13 through which production fluids drain into the casing. Dual tubing strings 14 and 15 pass through a dual packer 16 set in the casing and the lower end of tubing 14 is closed. An H-member 17, with cross flow passage 18, is included in the tubing strings below the packer. Below the H-member in tubing string 15 is a foot valve 19 of this invention.

Figure 2A:
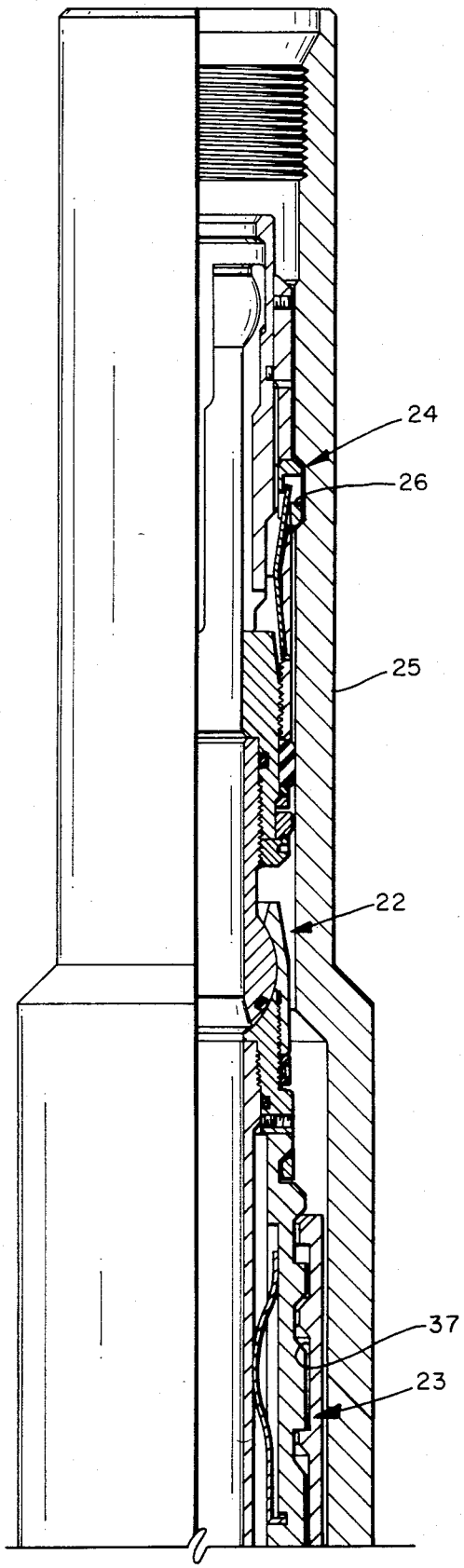
FIGS. 2A–2C are an elevational drawing in half section, showing a tool string, including an improved standing valve of this invention, installed and locked in an open improved foot valve.
Figure 2B:
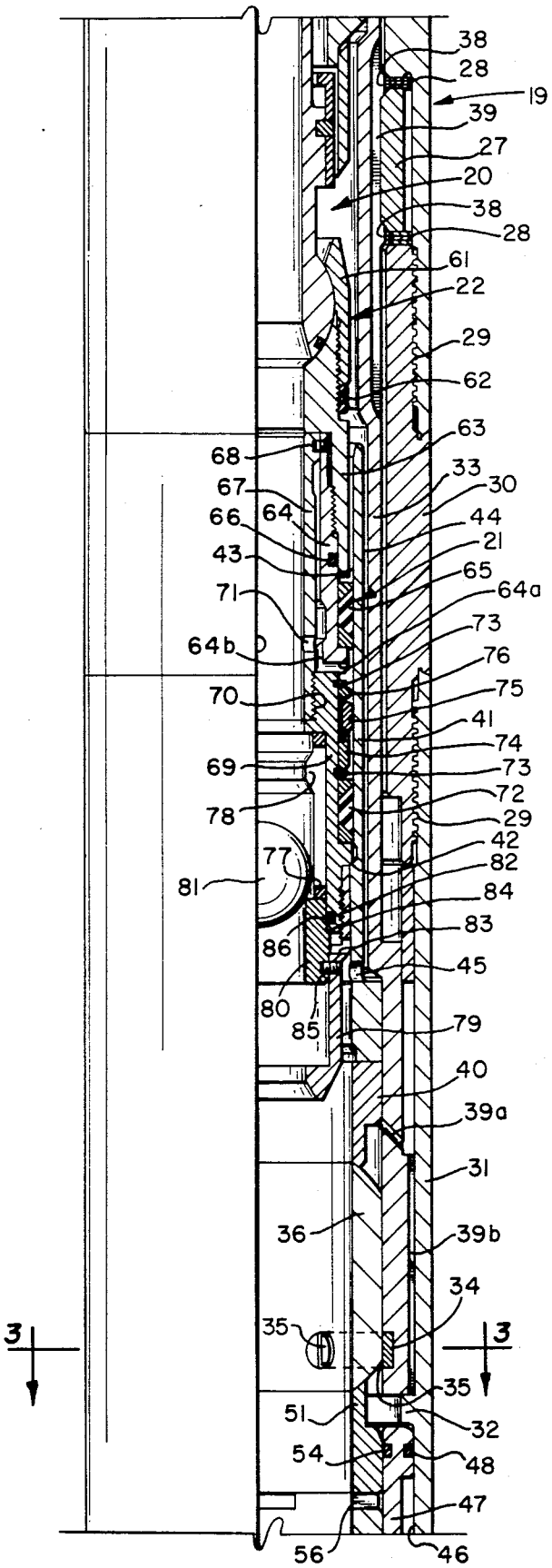
Figure 2C:
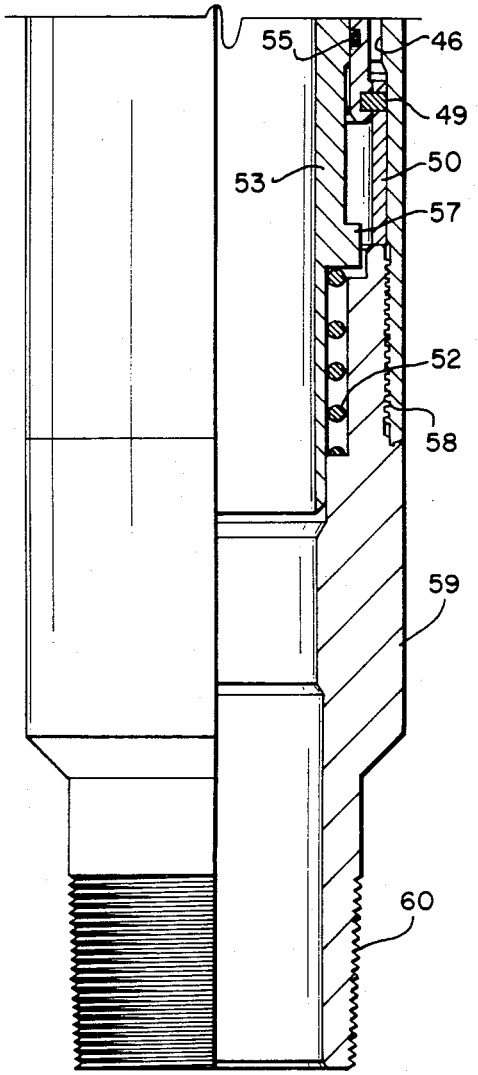

The foot valve is operated by a tool string 20, FIG. 2, which includes an extendable standing valve 21 of this invention connected with sealed swivel connector 22 to an improved shifting tool 23 of the previously mentioned copending U.S. application, which may be connected with another connector 22 to an appropriate locking mandrel 24. The foot valve and invention well system may be operated without a locking mandrel in the tool string. The locking mandrel is useful to lock the preferred embodiment tool string in the open foot valve to prevent production flow from prematurely lifting the tool string, closing the foot valve and stopping production.

If a locking mandrel is included in the tool string, a running tool and pump down piston are connected above. If the locking mandrel is not used, the pump down pistons are connected above the shifting tool.

The foot valve 19, FIG. 2, has an appropriate connection on the upper end of upper body 25 for connection in well tubing. This upper body is provided with profiled grooving 26 therein, for engagement by a locking mandrel. There is a seal bore immediately below grooving 26 for sealing engagement with any seal on a locking mandrel engaging this grooving. Housed in a bore near the lower end of the upper body is an expandable c-ring 27, with spacer rings 28 above and below. The spacer rings are useful in positioning the c-ring slightly upward or downward as required for proper operation.

Figure 3:
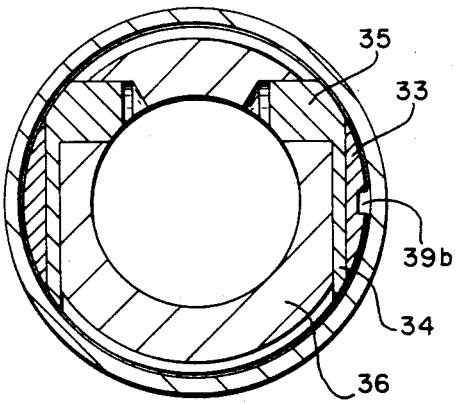
FIG. 3 shows a section through the foot valve along line 3—3 of FIG. 2.

Connected to the lower end of the upper body with an appropriate thread 29 is a body connector 30. Intermediate body 31 is connected to the lower end of the connector by another appropriate thread 29. Body 31 is provided with an internal shoulder 32. Housed for reciprocating movement in the foot valve is an actuator 33, the lower end of which receives pivots 34 having pins 35 extending into holes in the sides of ball valve member 36 (FIG. 3). Downward movement of the actuator rotates the ball valve to open position, and upward actuator movement rotates the ball to closed position. In the upper end of actuator 33 is profiled grooving 37 engageable by a shifting tool. The actuator has external shoulders 38, both shoulders having upward and downward tapered portions and slots 39 providing flow passages through. The actuator also has a flow port **39*a* and lower flow slot 39*b***.

Slidably mounted in the actuator is an upper annular seat 40, which rests on the valve ball but does not seal with it. Mounted for reciprocating movement in the actuator and resting on the upper seat is an extention 41 having an internal shoulder 42 and a seal bore 43. Clearance between the outside of extension 41 and the inside of actuator 33, provides an annular flow passage 44, and a port 45 is provided through the wall of actuator 33.

Slidably mounted in intermediate body bore 46 below shoulder 32 is a piston 47, sealed in the bore with resilient seal 48 and positioned by shear pins 49 through holes in sleeve 50 protruding into a piston groove.

A lower annular seat 51 is maintained in sealing contact with ball valve 36 by spring 52 biasing the lower seat extension 53 and lower seat upwardly. Piston 47 is slidably sealed to seat 51 with upper resilient seal 54 and slidably sealed to extension 53 with lower resilient seal 55. The lower seat extension has flow slots 56 in the upper end and an intermediate external shoulder 57.

Connected to the lower end of body 31 with an appropriate thread 58 is lower body 59, having an appropriate thread 60 for connection in tubing.

The extendable standing valve 21 of this invention, as seen in the preferred form in FIG. 2, has a connector cap 61 and jam nut 62 threaded onto the upper end of upper body 63 for connection to a tool string. The upper body is threaded onto mandrel 64, retaining resilient seal 65 and is sealed to the mandrel with resilient seal 66. In the lower end of mandrel 64 is a flow slot **64*a* connecting into an internal flow slot 64*b***.

The mandrel is slidably disposed around extension 67 and retained in the unextended position by shearable screw 68, threaded through mandrel 64 and protruding into holes in the extension. The extension is connected to lower valve body 69 with threads 70 and has ports 71 through the extension wall. The extendable standing valve may also take the form of having a connector 22 connecting extension 67 and body 69, in place of thread 70.

Mounted on the body 69 is a resilient seal 72 retained by retaining ring 73 in a groove in the lower body. Mounted on the body above the retaining ring is a retainer 74, a wear ring 75 and a ring 76, retained by an upper retaining ring 73 in another groove in the lower body. The wear ring is made slightly larger than resilient seals 72 and 65 and is cut to form a c-ring. The wear ring centralizes the resilient seals when running down tubing, preventing abrasive wear on the seals. The outside diameter of the cut wear ring may be biased smaller and reduced to less than the diameter of the adjacent resilient seals.

Slidably housed in a bore in the lower body is a sleeve 77 having an internal shoulder 78 and slots through its wall. Also slidably housed, partially in a lower body bore and partially in a bore in guide 79, is a seat 80, on which ball 81 is seated by gravity, preventing down flow through the standing valve. Guide 79 is connected to the lower body with thread 82. The guide has ports 83 through its wall and an internal shoulder 84.

Seat 80, when positioned up by shearable screws 85, is sealed in lower valve body by resilient seal 86. Screws 85 are threaded through the wall of guide 79 and protrude into a groove in the lower end of the annular seat.

To operate the well system of this invention, component parts should be installed in a well as shown in FIG. 1, with the foot valve 19 closed, preventing down flow. To open the foot valve and the well for production flow, a tool string 20, with standing valve 21 not extended, is lowered through tubing into the foot valve. The tool string may be pumped down or lowered on wireline.

As the tool string shifting tool 23 enters the foot valve, the shifting tool keys engage the profiled grooving 37 in actuator 33. Continued downward movement of the tool string and actuator, rotates the valve ball 36, through pivots 34 and pins 35, to foot valve open position. Standing valve seals 65 and 72 are positioned and sealing in bore 43 in extension 41. The seal on locking mandrel 24, if included in the tool string, is positioned and sealing in the seal bore below grooving 26 and the locking mandrel may be operated to lock in grooving 26, locking the tool string in and the foot valve open as seen in FIG. 2.

As the actuator moved downwardly, lower shoulder 38 expanded c-ring 27 and moved fom above to below the c-ring, and the c-ring recontracted between upper and lower shoulders 38. The contracted c-ring alone will retain the actuator down and foot valve open if the tool string does not include a locking mandrel.

Production flow may now occur up through the open foot valve and tool string, lifting and flowing around standing valve ball 81. Ball 81, seated by gravity and pressure from above on seat 80, will prevent flow down through the open foot valve into the producing formation 12.

Figure 4A:
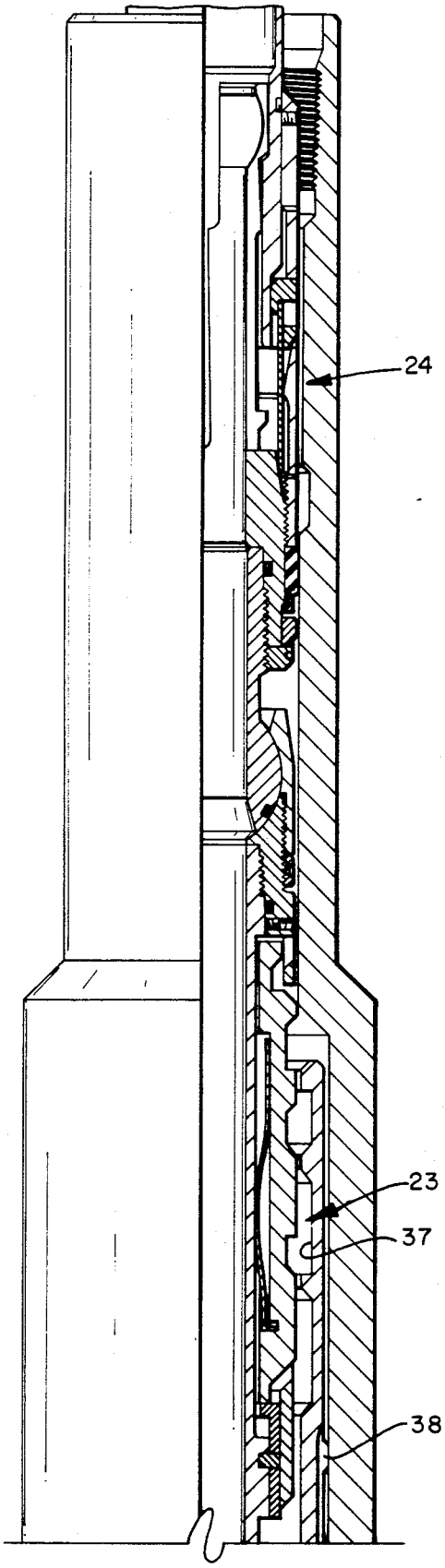
FIGS. 4A–4C are an elevational drawing, in half section, of a closed improved foot valve with the tool string unlocked for retrieval and improved standing valve extended.
Figure 4B:
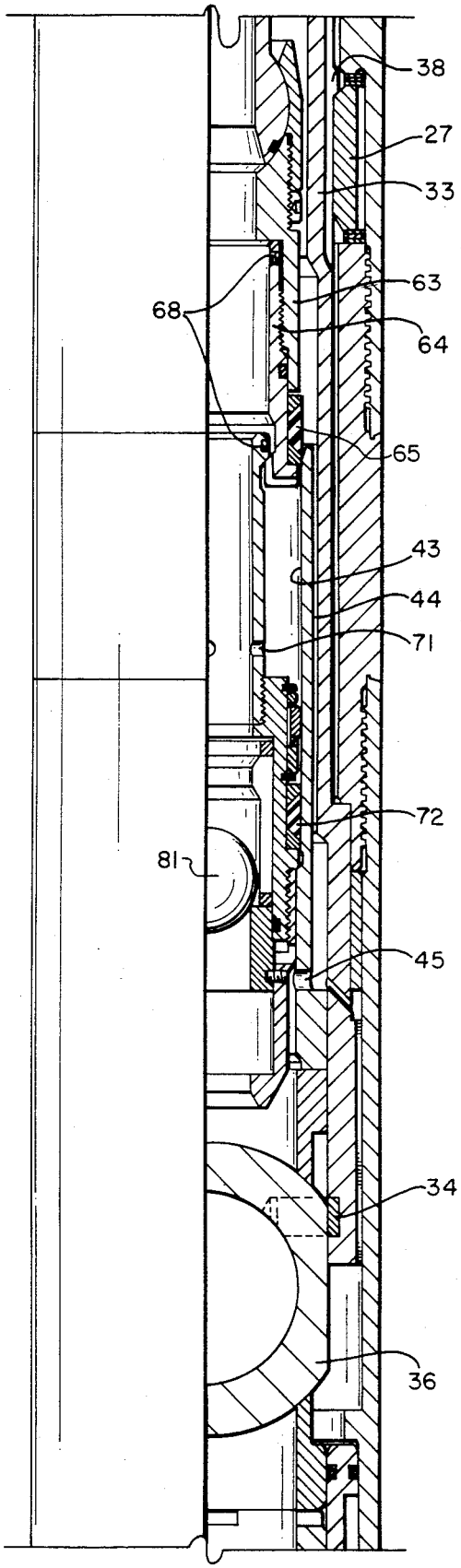
Figure 4C:
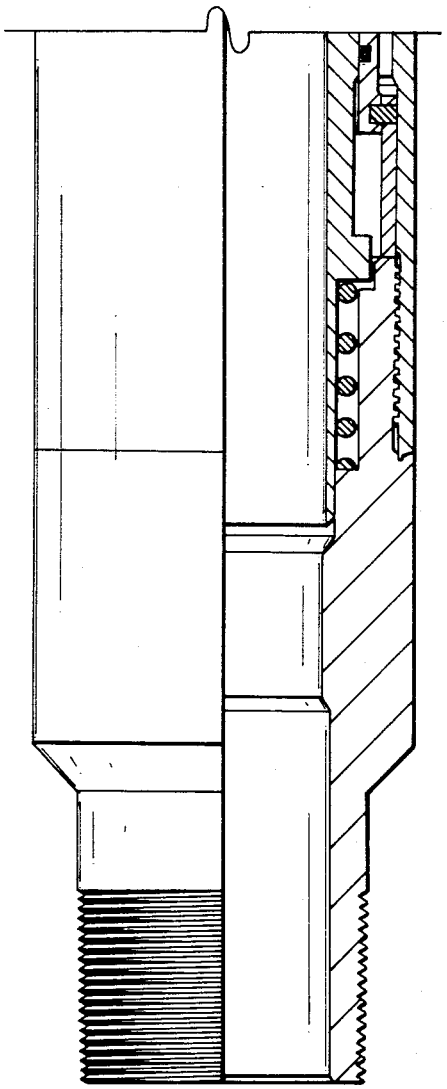

When the tool string is pumped down into and opens the foot valve, the pump down pistons remain in tubing 15 above the H-member to be later pumped out. When it is desired to pump the tool string out and close the foot valve, pressure is applied to tubing string 14 down through the H-member cross flow 18 and up under the tool string pistons. This pumpout pressure is also transmitted down inside the tool string through standing valve extension ports 71 and mandrel slots **64*b* and 64*a* into upper seat extension bore 43 between resilient seals 65 and 72. Shoulder 42 prevents pump out pressure down on seal 72 and seated ball 81 from moving lower valve body 69 down. Increased pumpout pressure acts upwardly on seal 65, and the tool string pistons above, to shear pins 68 and move upper body 63, mandrel 64, shifting tool 23 and actuator 33 upwardly, extending the standing valve, rotating ball 36 to close the foot valve, and unlocking locking mandrel 24 if used. When lower shoulder 38 has expanded and moved through to above c-ring 27, the ball has rotated fully closing the foot valve, and the standing valve has extended so that seal 65 is out of extension bore 43, as shown in FIG. 4B**.

Pumpout fluids may now flow from inside the tool string out through ports 71 by seal 65 down through annular clearance 44 and in port 45 equalizing pressures above and below valve ball 81.

Further upward movement of the tool string automatically disengages the tool string shifting tool 23 from the actuator profiled grooving 37, releasing the tool string to be pumped back to surface. The closed foot valve prevents pressure on or flow into producing formation 12.

The c-ring, contracted below lower shoulder 38, retains the actuator in up foot valve closed position.

Figure 5:
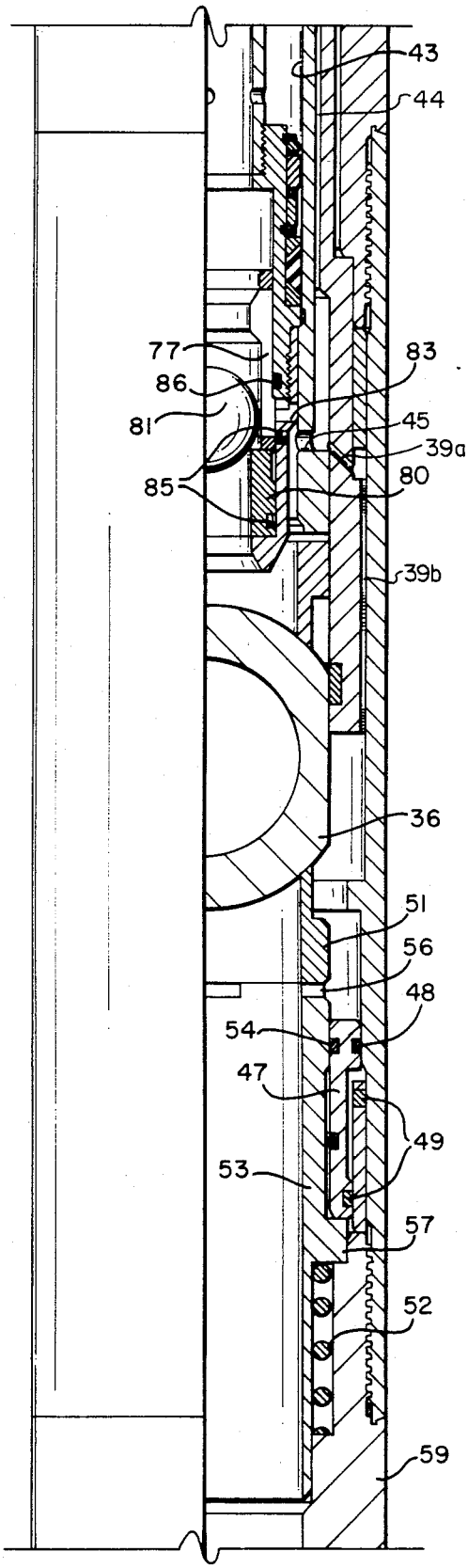
FIG. 5 is a half section elevational drawing showing the invention valves in position for pump in flow.

Both the standing valve and foot valve of this invention may be pressured sufficiently from above and positioned for down flow around into the producing formation as shown by FIG. 5.

When the standing valve is sealed in extension seal bore 43, sufficient pressure applied on seated standing valve ball 81 will shear screws 85 and move seat 80 down from sealing engagement in resilient seal 86. Down flow from inside the tool string through slots in sleeve 77 and ports 83 may now occur, bypassing valve ball 81 seated on seat 80.

When pressure is applied on closed foot valve ball 36 and piston 47, through clearance 44, port 45 and flow passages **39*a* and 39*b*, piston 47 is moved downwardly, compressing spring 52, until shoulder 57 on extension 53 contacts the upper end of lower body 59. Sufficient down pressure to shear pins 49, will move piston 47 further down, positioning resilient seals 54 and 48 below extension slots 56. Down flow through the foot valve around closed valve ball 36 sealing on seat 51 may now occur through slots 56**.

What we claim is:

1. A well system comprising:

a. a foot valve, connectable in tubing for controlling well flow, including (1) a body having a bore therethrough and profiled grooves therein, (2) a valve member and lower seat controlling flow through the bore, (3) an actuator, having profiled grooves therein, positioning the valve member in open position when the actuator is moved to down position and positioning the valve member in closed position when the actuator is moved to up position, (4) an upper seat, in said actuator, having a bore therethrough and a shoulder therein, (5) retaining means, retaining said actuator in down valve member open position or in up valve member closed position; and b. a tool string to operate the foot valve, including (1) a standing valve, having an extendable body with an external shoulder thereon engageable with said upper seat shoulder preventing downward movement of the tool string, a valve member and a seat therein permitting upward flow and preventing downward flow through the body, upper and lower seal means on the exterior of said extendable body sealing between said standing valve and said upper seat bore when said body is not extended and frangible means preventing extension of said extendable body; and (2) a releasable shifting tool, having keys profiled to selectively engage said actuator grooves and move the foot valve member to open position as the tool string is lowered into the foot valve, and when said tool string is raised from said foot valve said frangible means are sheared and said standing valve body is extended moving said upper body seal means upwardly out of sealing engagement with said upper seat bore, permitting pressure communication to below said standing valve member and seat, moving said releasable shifting tool and engaged actuator upwardly to foot valve closed position and further upward to release said shifting tool from said actuator and raise said tool string from said foot valve.

2. The well system of claim 1 wherein both the standing valve and foot valve are provided with bypass means permitting downward fluid flow around the valve members when in closed position in response to selected downward pressures applied on each valve member.

3. The well system of claim 1 wherein the tool string further includes a locking mandrel having keys profiled to engage said foot valve body grooves and operable to lock said tool string in said foot valve and lock said foot valve open.

4. A standing valve comprising an extendable body including an upper body with seal means thereon and a lower body with seal means thereon, a shoulder below said lower seal means, and a valve ball and cooperating annular seat slidably disposed and sealingly and releasably positioned in the lower body, permitting upward flow and preventing downward flow through the standing valve and pressure responsive means therein for releasing and sliding said seat to disengage the lower body seal and permit downward flow through said standing valve, after application of selected pressure thereon.

5. The valve of claim 4 wherein the pressure responsive means include the annular seat and a resilient seal in the body releasably positioned in sealing engagement by a shear pin through said body protruding into a hole in said seat below said seal.

6. The standing valve of claim 5 further including a wear ring on the body between the upper and lower body seal means, slightly larger than said seal means, cut to form a c-ring.

7. A foot valve comprising:

a. a body, connectable in well tubing;

b. a ball valve member mounted for rotation in said body;

c. an actuator, slidable in the body and cooperable with the ball valve member to rotate it to open or closed position;

d. retaining means retaining said actuator in down ball valve member open position or in up ball valve member closed position;

e. an annular seat in the actuator above the ball valve member having a bore therethrough and a shoulder in said bore;

f. an annular seat below the ball valve member cooperable with the valve member to control flow through the foot valve, said seat having flow passages through the wall thereof;

g. an upward resilient bias around the cooperable seat maintaining flow control cooperation of valve member and lower annular seat;

h. an annular piston slidably mounted around said cooperable seat in the foot valve body and releasably secured to the body; and i. seal means on the annular piston sealingly engaging the cooperable seat above and below the seat flow passages and seal means on said annular piston sealingly engaging the foot valve body, said piston movably by pressure on the sealed annular area between said piston-cooperable seat seal above the flow passages and the piston-foot valve body seal, sufficient to release the annular piston from the foot valve body and move the piston-seat seal downwardly to below said flow passages, permitting fluid to flow through said seat flow passages, preventing said ball valve member and cooperating annular seat from controlling flow through the foot valve.

8. The foot valve of claim 7 wherein the retaining means include spaced apart shoulders on said actuator movable longitudinally to expand and move through a c-ring housed around said actuator in said foot valve body.

9. The foot valve of claim 8 wherein the retaining means further include spacer rings above and below the c-ring.

10. A pump down well system comprising:

a. casing the well;

b. dual tubing strings in said casing, passing through a dual packer set in the casing above a producing formation;

c. an H-member in said tubings below said packer, one of said tubings communicating with said producing formation and the other said tubing closed below the H-member;

d. a foot valve below the H-member in said tubing communicaing with the formation; and e. a tool string including a releasable shifting tool and a standing valve for opening and closing said foot valve to control flow from and into the producing formation, said standing valve preventing flow into said producing formation when said tool string is lowered into said foot valve opening said foot valve and the well for production flow.

11. The well system of claim 10 wherein both the standing valve and foot valve are provided with means permitting downward fluid flow around the valve members when in closed position in response to selected downward pressures applied on each valve member.

12. The well system of claim 10 wherein the tool string further includes a locking mandrel.

* * * * *